US008236110B2

(12) United States Patent
Mukai et al.

(10) Patent No.: US 8,236,110 B2
(45) Date of Patent: Aug. 7, 2012

(54) METHOD OF PRODUCING GRAIN-ORIENTED ELECTRICAL STEEL SHEET

(75) Inventors: Takao Mukai, Tokyo (JP); Shinya Hayashi, Tokyo (JP); Atsushi Tanaka, Tokyo (JP); Hiroyuki Mimura, Tokyo (JP); Hisataka Uto, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 367 days.

(21) Appl. No.: 12/450,996

(22) PCT Filed: Apr. 22, 2008

(86) PCT No.: PCT/JP2008/058229

§ 371 (c)(1),
(2), (4) Date: Oct. 20, 2009

(87) PCT Pub. No.: WO2008/133337

PCT Pub. Date: Nov. 6, 2008

(65) Prior Publication Data

US 2010/0084058 A1 Apr. 8, 2010

(30) Foreign Application Priority Data

Apr. 24, 2007 (JP) ..... 2007-114255

(51) Int. Cl.
*H01F 1/147* (2006.01)
*H01F 1/16* (2006.01)

(52) U.S. Cl. ..... 148/111; 148/308

(58) Field of Classification Search ..... None
See application file for complete search history.

(56) References Cited

U.S. PATENT DOCUMENTS 3,990,924 A * 11/1976 Matsumoto et al. ..... 148/111
(Continued)

FOREIGN PATENT DOCUMENTS

JP 46-23820 7/1971
(Continued)

OTHER PUBLICATIONS

International Search Report dated Jul. 22, 2008 issued in corresponding PCT Application No. PCT/JP2008/058229.

*Primary Examiner* — John Sheehan
(74) *Attorney, Agent, or Firm* — Kenyon & Kenyon LLP

(57) ABSTRACT

The invention produces a grain-oriented electrical steel sheet having a primary recrystallization structure in which Goss-oriented crystal grains and crystal grains having a coincidence orientation relationship to the Goss orientation are aligned in the rolling direction. It is characterized heating a slab containing, in mass %, C: 0.025 to 0.10%, Si: 2.5 to 4.5%, Mn: 0.03 to 0.55%, and Al: 0.007 to 0.040% to 1,100 to 1,450° C. or greater; hot rolling the slab to obtain a hot-rolled sheet; annealing the hot-rolled sheet; cold rolling the annealed sheet multiple times with a split-housing reversible cluster rolling mill; and subjecting the cold-rolled sheet to primary recrystallization annealing followed by secondary recrystallization annealing, in which method: (a) a first cold rolling or first and second cold rollings are performed using a small-diameter work roll of 55 mm to less than 105 mm diameter; (b) a second or third cold rolling to a penultimate cold rolling are performed using a large-diameter work roll of 105 mm to less than 150 mm diameter; and (c) a final cold rolling is conducted using a small work roll of a diameter smaller than the diameter of the large-diameter work roll.

7 Claims, 6 Drawing Sheets

U.S. PATENT DOCUMENTS

| | | | | | |
|---|---|---|---|---|---|
| 5,143,561 | A | * | 9/1992 | Kitamura et al. | 148/111 |
| 5,346,559 | A | * | 9/1994 | Ushigami et al. | 148/111 |
| 5,614,034 | A | * | 3/1997 | Suga et al. | 148/111 |
| 5,666,842 | A | * | 9/1997 | Komatsubara et al. | 72/200 |

FOREIGN PATENT DOCUMENTS

| | | |
|---|---|---|
| JP | 50-37130 | 12/1975 |
| JP | 54-13846 | 6/1979 |
| JP | 54-29182 | 9/1979 |
| JP | 62-040315 | 2/1987 |
| JP | 02-259020 | 10/1990 |
| JP | 02-282422 | 11/1990 |
| JP | 04-289121 | 10/1992 |
| JP | 05-033056 | 2/1993 |
| JP | 09-287025 | 11/1997 |
| JP | 2001-192732 | 7/2001 |
| JP | 2002-129234 | 5/2002 |
| JP | 2006-207026 | 8/2006 |
| RU | 2164451 | 3/2001 |
| RU | 2224030 | 2/2004 |

* cited by examiner (a)

(b)

METHOD OF PRODUCING GRAIN-ORIENTED ELECTRICAL STEEL SHEET

This application is a national stage application of International Application No. PCT/JP2008/058229, filed 22 Apr. 2008, which claims priority to Japanese Application No. 2007-114255, filed 24 Apr. 2007, which is incorporated by reference in its entirety.

FIELD OF THE INVENTION

This invention relates to a method of producing a grain-oriented electrical steel sheet for use in the iron cores of transformers, generators and other electrical equipment.

DESCRIPTION OF THE RELATED ART

Owing to increased concern about energy conservation in recent years, a strong need has come to be felt for transformers, generators and other electrical equipment offering low core loss, small size and light weight. Meeting this need requires the development of grain-oriented electrical steel sheet that is thin and high in magnetic flux density.

Thanks to marked advances in production technology, it is today possible to produce grain-oriented electrical steel sheet of 0.23 mm thickness exhibiting magnetic flux density B8 (value at magnetizing force of 800 A/m) of 1.92 T, and core loss W17/50 (value at 50 Hz and maximum magnetic flux density of 1.7 T) of 0.85 W/kg.

Production of grain-oriented electrical steel sheet having such excellent magnetic properties requires formation during final finish annealing of a secondary recrystallization texture whose secondary recrystallized grains are highly oriented in the {110}<001> direction (Goss direction).

In order to form a secondary recrystallization texture that is strongly oriented in the Goss direction, it is indispensable (i) to form a primary recrystallization structure conducive to preferential growth of Goss-oriented secondary recrystallized grains and (ii) to control growth of crystal grains with undesirable orientations, i.e., other than Goss orientation, with inhibitor during the secondary recrystallization process.

The general practice is to use a precipitate such as AlN, Mn(S, Se) or $Cu_2$ (S, Se) as the inhibitor, and supplementally use a grain boundary segregation type element such as Sn or Sb (see, for example, Japanese Patent Publication (B) No. S46-23820 and Japanese Patent Publication (A) No. S62-40315). In a production method using inhibitor, however, high magnetic flux density cannot be obtained without forming a suitable primary recrystallization structure.

For formation of the suitable primary recrystallization structure, it is important to establish uniform crystal grain diameter and align the Goss-oriented crystal grains and the crystal grains having a coincidence orientation relationship to the Goss orientation in the rolling direction. However, these factors are strongly influenced by the cold rolling condition. Because of this, numerous cold rolling technologies have been proposed (See, for example, Japanese Patent Publication (B) No. S54-13846 and No. S54-29182, and Japanese Patent Publication (A) No. H4-289121).

Cold rolling is conducted by either reversible rolling (see Japanese Patent Publication (B) No. S54-13846 or tandem rolling (see Japanese Patent Publication (B) No. S54-29182). The mode mainly used today is reversible rolling in which high-temperature rolling utilizing deformation heating is conducted and the aging effect following inter-rolling reel winding is utilized.

The deformation resistance of a steel sheet with a high Si content is large. Therefore, when the steel sheet is reversibly-rolled using a large-diameter work roll, the resulting large rolling reaction force restricts the rolling reduction limit.

However, when a small-diameter work roll is used, the contact area with the steel sheet is small, so that the rolling reduction limit increases because the rolling reaction force is smaller for any given rolling reduction. Therefore, when rolling at a high reduction ratio, it is advantageous to use a small-diameter work roll (see Japanese Patent Publication (B) No. S50-37130 and Japanese Patent Publication (A) No. H2-282422, No. H5-33056 and No. H9-287025).

Generally speaking, work roll diameter reduction increases the likelihood of roll deformation and is therefore undesirable from the aspects of the shape and magnetic properties of the steel sheet. However, Sendzimir mills and NMS mills equipped with 6-, 12- and 20-roll clusters are built so that the rolls support the work roll multidirectionally, thereby inhibiting roll deformation and enabling use of a small-diameter work roll. For this reason, most grain-oriented electrical steel sheet production is conducted using reversible cluster rolling mills.

The mainstream reversible cluster rolling mills are Sendzimir rolling mills, typically the ZR21 and ZR22 mills. In order to ensure the rolling property of thin steel sheet, these rolling mills are usually equipped with small work rolls of 95-mm or smaller diameter. Japanese Patent Publication (A) No. H9-287025, for example, describes embodiments using 80-mm and 90-mm diameter work rolls.

As shown in FIG. 1(*a*), Sendzimir rolling mills typified by the ZR21- and ZR22 mills are installed in monoblock housings. In the case of a monoblock housing, only a fixed amount of space is available inside the housing. So when changing the work roll, the diameter of the replacement roll that can be inserted is limited.

In contrast, as shown in FIG. 1(*b*), in the case of a Sendzimir rolling mill built into a split housing, the space inside the housing can be adjusted by moving the housing halves vertically. This makes it possible to change the work roll diameter in accordance with the type, thickness and other steel sheet conditions, and also with the rolling conditions. Recent advances in equipment and operation technologies, together with the development of the NMS mill, now enable use of work rolls of 95-mm or larger diameter.

Against this backdrop, the applicant studied the effect of work roll diameter on magnetic properties.

It was learned that that magnetic properties improve when the diameter of the work roll is 95 to 170 mm. A technology was therefore developed for producing grain-oriented electrical steel sheet excellent in magnetic properties using a reversible cluster rolling mill with a work roll diameter of 95 to 170 mm (see Japanese Patent Publication (A) No. 2001-192732 and No. 2002-129234).

SUMMARY OF THE INVENTION

The technology taught by the applicant's Japanese Patent Publication (A) No. 2001-192732 is aimed at improving the magnetic properties of grain-oriented electrical steel sheet by using a 95 to 170 mm diameter work roll. It is directed to exploiting the advantage of using a small-diameter work roll, namely the high-reduction property, and not to improving productivity.

Japanese Patent Publication (A) No. 2002-129234 is based on the metallurgical knowledge that "a cluster mill large diameter work roll produces a marked effect in upstream rolling passes" and teaches a technology for producing grain-oriented electrical steel sheet using a cluster mill equipped with a split-housing in which the upstream passes of the rolling are conducted with a large-diameter work roll and downstream passes are conducted with the work roll changed to one of small diameter. Namely, it teaches a method of using a large-diameter work roll in the upstream passes of upstream rolling.

With this method, however, the initial pass of the cold rolling, in which large thickness reduction is intrinsically desired, is also done using a large-diameter roll, so that a drawback of a heavy restraint on roll bite and other rolling aspects is experienced in the initial pass.

In cold rolling of grain-oriented electrical steel sheet, use of a small diameter work roll, e.g., one with a diameter of 90 mm or less, has been believed to degrade, not improve, magnetic properties. However, the present invention is directed to exploiting the high-reduction property of a small-diameter work roll to the utmost and to form a primary recrystallization structure that exhibits uniform crystal grain diameter and wherein the Goss-oriented crystal grains and the crystal grains having a coincidence orientation relationship to the Goss orientation are aligned in the rolling direction The object of the present invention is to provide a method of producing a grain-oriented electrical steel sheet that achieves this purpose.

The inventors took note of the fact that a Sendzimir rolling mill equipped with a split housing enables the work roll to be changed in accordance with the type, thickness and other steel sheet conditions, and also with the rolling conditions.

The inventors further discovered that when rolling using a small-diameter work roll is followed by rolling using a large-diameter work roll, a primary recrystallization structure can be formed that exhibits uniform crystal grain diameter and wherein the Goss-oriented crystal grains and the crystal grains having a coincidence orientation relationship to the Goss orientation are aligned in the rolling direction.

In addition, the inventors discovered that a still more preferable primary recrystallization structure can be formed by performing inter-pass aging during the rolling using the large-diameter work roll.

The present invention was made based on the foregoing knowledge and the gist thereof is as set out below.

(1) A method of producing a grain-oriented electrical steel sheet comprising:

heating a slab containing, in mass %, C: 0.025 to 0.10%, Si: 2.5 to 4.5%, Mn: 0.03 to 0.55%, and Al: 0.007 to 0.040% to 1,100 to 1,450° C. or greater;

hot rolling the slab to obtain a hot-rolled sheet;

annealing the hot-rolled sheet;

cold rolling the annealed sheet multiple times with a split-housing reversible cluster rolling mill; and subjecting the cold-rolled sheet to primary recrystallization annealing followed by secondary recrystallization annealing, in which method of producing a grain-oriented electrical steel sheet:

(a) a first cold rolling or first and second cold rollings are performed using a small-diameter work roll of 55 mm to less than 105 mm diameter;

(b) a second or third cold rolling to a penultimate cold rolling are performed using a large-diameter work roll of 105 mm to less than 150 mm diameter; and (c) a final cold rolling is conducted using a small work roll of a diameter smaller than the diameter of the large-diameter work roll.

(2) A method of producing a grain-oriented electrical steel sheet according to (1), wherein the diameter of the small-diameter work roll is 70 to 95 mm.

(3) A method of producing a grain-oriented electrical steel sheet according to (1), wherein the diameter of the large-diameter work roll is 115 mm to less than 150 mm.

(4) A method of producing a grain-oriented electrical steel sheet according to any of (1) to (3), wherein the diameter of the small-diameter work roll used in the final cold rolling is 55 mm to less than 105 mm.

(5) A method of producing a grain-oriented electrical steel sheet according to any of (1) to (4), wherein inter-pass aging is performed at 100 to 350° C. for 1 min or greater during the second or third cold rolling to the penultimate cold rolling.

(6) A method of producing a grain-oriented electrical steel sheet according to (5), wherein the aging is performed using deformation heating.

(7) A method of producing a grain-oriented electrical steel sheet according to any of (1) to (6), wherein the number of cold rollings is 3 to 7.

DETAILED DESCRIPTION OF THE INVENTION

The inventors heated an electrical steel slab containing, in mass %, C: 0.005%, Si: 3.3%, Mn: 0.1%, S: 0.07%, Al: 0.0282%, N: 0.0070%, and Sn: 0.07% to 1,150° C., hot rolled the slab to produce a 1.8 mm hot-rolled sheet, annealed the hot-rolled sheet at 1,100° C., and cold rolled the annealed sheet 6 times to a total reduction of 90% with a split-housing reversible cluster rolling mill, thereby obtaining a 0.18-mm thick steel sheet. Aging for 5 min at 200° C. was suitably performed between the rollings.

During multiple runs of the process, the first cold rolling (hereinafter sometimes called the "first pass") and the final cold rolling (hereinafter sometimes called the "final pass") were conducted using work rolls differing in diameter within the range of 65 to 97 mm, and the rolling loads were measured. In addition, the second to penultimate rollings (hereinafter sometimes called the "intermediate passes") were conducted using work rolls differing in diameter within the range of 95 to 180 mm, and the rolling loads were measured. The pass schedule was the same in all runs. The results are shown in FIG. 2.

It can be seen from FIG. 2 that the rolling load range of the 65 to 97 mm diameter work rolls (hereinafter sometime called the "small-diameter work rolls") and the rolling load range of the 95 to 180 mm diameter work rolls (hereinafter sometime called the "large-diameter work rolls") were substantially the same.

Although the rolling efficiency of a reversible rolling mill can be increased by increasing the reduction per pass, this tends to make the roll bite unstable and heighten the risk of breakage. A limit reduction is therefore defined for every set of sheet thickness, temperature and other conditions in the individual passes.

Figure 2:
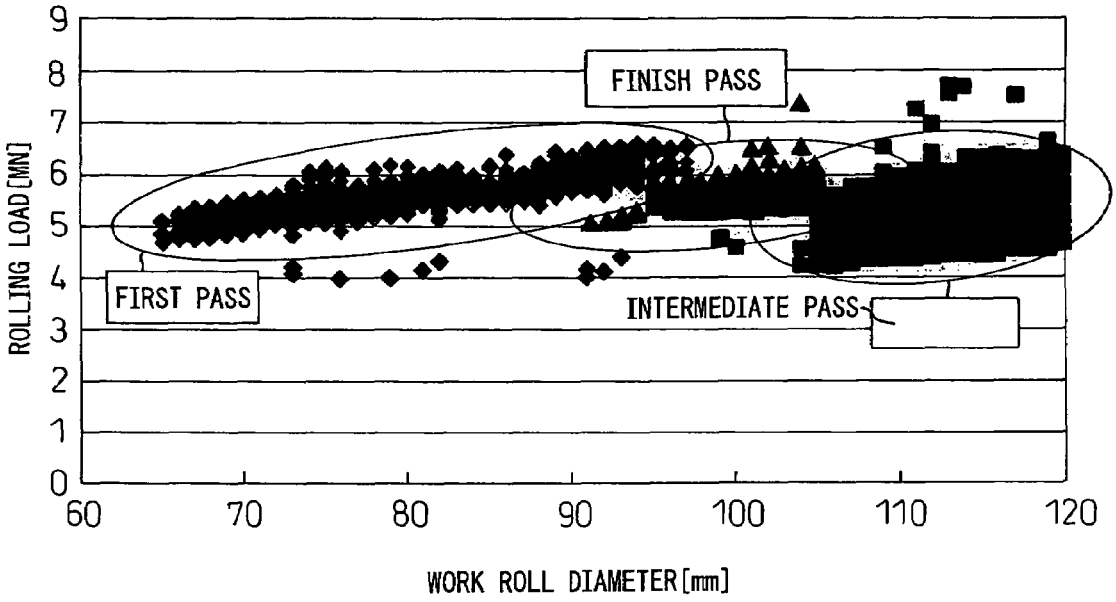
FIG. 2 is a diagram showing how rolling load varies with work roll diameter.

In order to realize the most efficient reduction in each pass while keeping the rolling reaction force within the load-bearing capacity of the bearings and other mill components, it is necessary, as shown in FIG. 2, to use a small-diameter work roll in the first pass.

This means that even if small-diameter work rolls are used in the initial rolling passes in which high reduction is desired (first and second passes) and in the final pass in which the work-hardened steel sheet must be rolled, rolling is possible at about the same rolling load as that in the case of using a large-diameter work roll in the intermediate passes.

Figure 3:
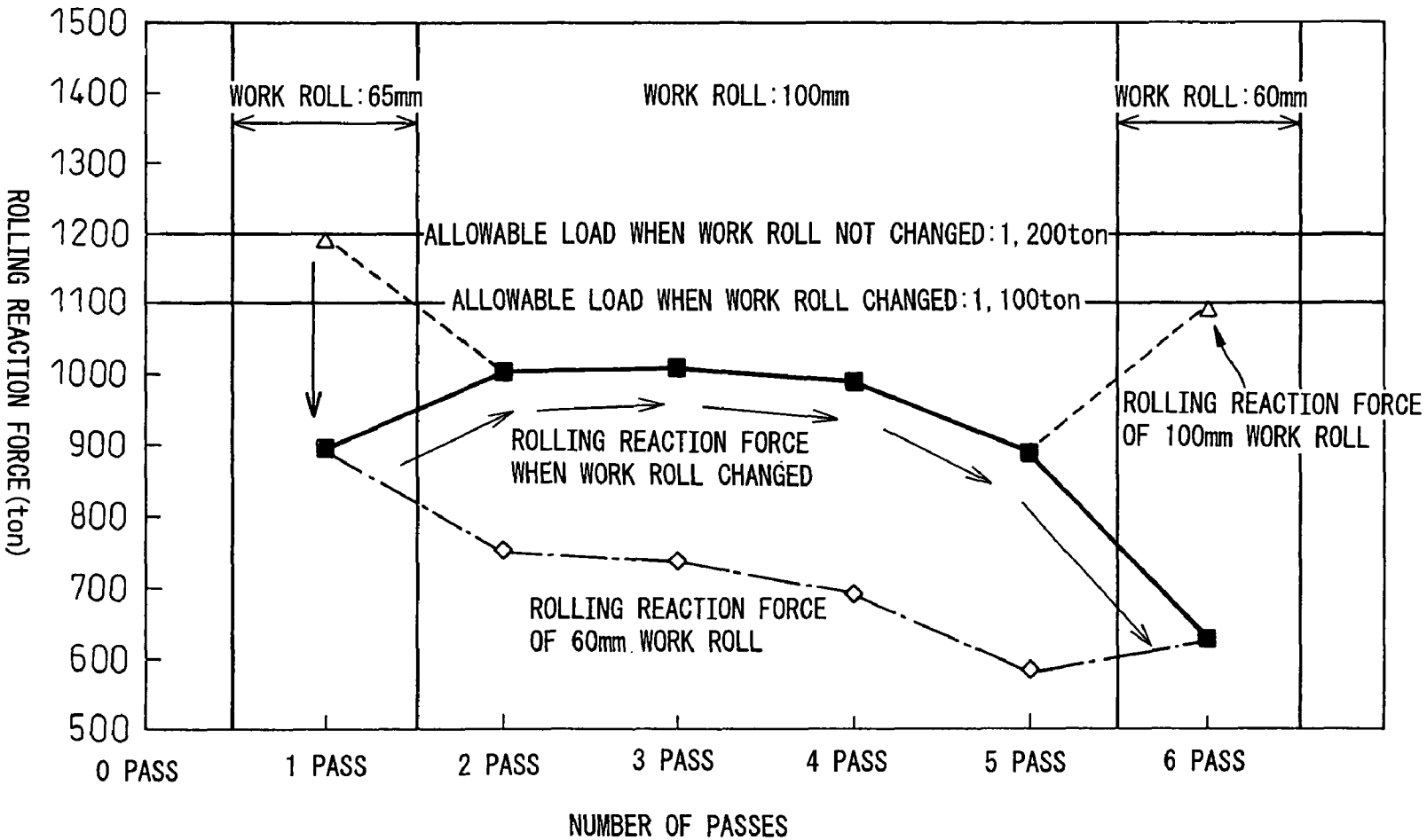
FIG. 3 is a diagram showing change in rolling reaction force when a small-diameter work roll was used in the first pass and a large-diameter work roll was used in the second to fifth intermediate passes.

FIG. 3 shows the change in rolling reaction force in a 6-pass schedule when a 65 mm small-diameter work roll was used in the first pass, a 100 mm large-diameter work roll was used in the second to fifth intermediate passes, and a 60 mm small-diameter work roll was used in the final (sixth) pass.

For comparison, the drawing also shows the rolling reaction forces for the case where a 100 mm large-diameter work roll was used in the first and final passes (see Δ in the drawing) and the case where a 60 mm small-diameter work roll was used in the intermediate and final passes (second and all following passes) (see 0 in the drawing).

The rolling reaction force in the first pass using the small roll was 900 t which is much lower than the allowable rolling load of 1,200 t. Even though the rolling reaction force rose in the intermediate passes owing to the use of the 100 mm large-diameter roll, the increase was to around 1,000 t, while in the final pass the increase owing to the use of the 100 mm large-diameter work roll was to around 1,100 t.

In this case, the allowable rolling load was 1,100 t throughout the rolling, which is a large decrease relative to the allowable rolling load of 1,200 t (=rolling reaction force in the first pass) when a 100 mm large-diameter work roll was used in all passes.

Although the allowable rolling load varies depending on the work roll diameter, it can be seen from FIG. 3 that the allowable rolling load can be greatly reduced by suitably selecting the diameters of the small-diameter work roll and large-diameter work roll. As a result, the number of passes required for rolling to the required sheet thickness can be reduced and sheet fracture can be prevented, thereby enabling a marked improvement in productivity.

Figure 4:
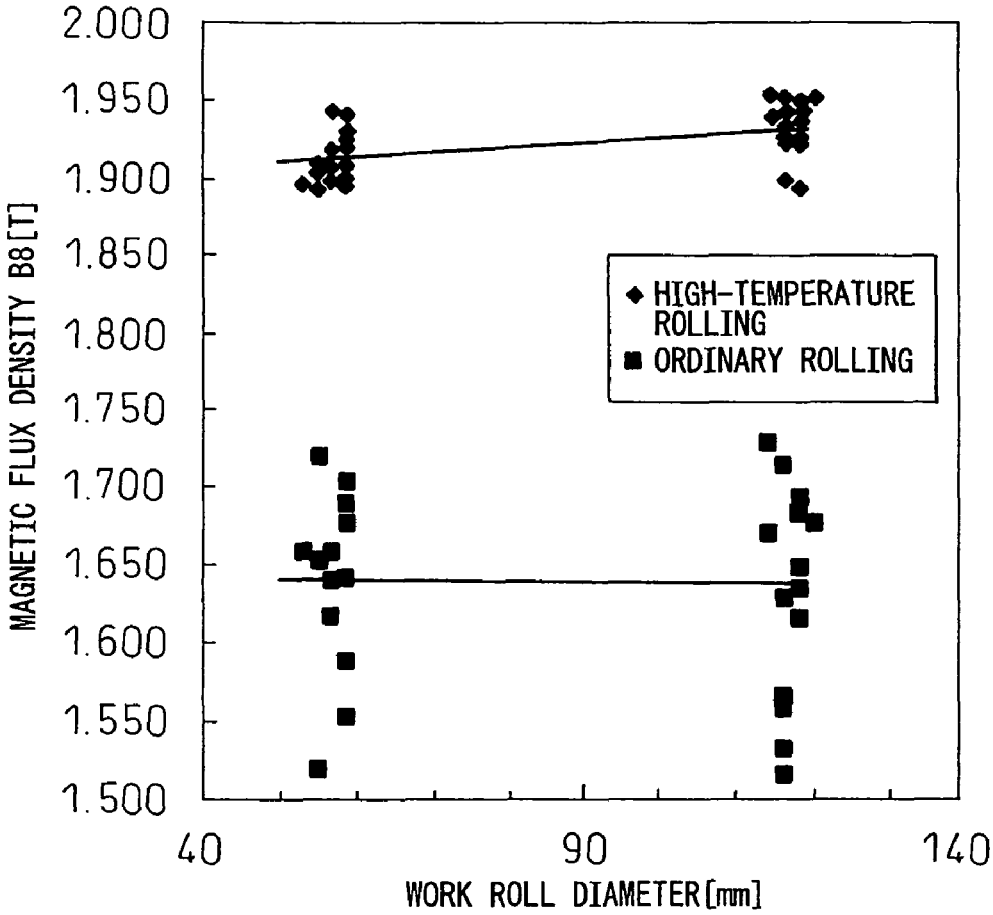
FIG. 4 is a diagram showing how magnetic flux density B8 varies with work roll diameter (mm).

The applicant's findings (see Japanese Patent Publication (A) No. 2001-192732 and No. 2002-129234) indicate that the magnetic properties of an electrical steel sheet can be improved by conducting rolling using a large-diameter work roll and concomitantly performing aging treatment using deformation heating FIG. 4 shows the magnetic flux densities B8 [T] of 0.23 mm thick electrical steel sheets produced by rolling with 50 to 60 mm small-diameter work rolls and the magnetic flux densities B8 [T] of 0.23 mm thick electrical steel sheets produced by rolling with 110 to 120 mm large-diameter work rolls. The magnetic flux densities in the case of high-temperature rolling utilizing deformation heating are shown above and the magnetic flux densities in the case of ordinary rolling with no aging treatment are shown below.

It can be seen that magnetic flux density B8 [T] did not improve when a small-diameter work roll was changed to a large-diameter work roll in ordinary rolling but magnetic flux density B8 [T] improved when high-temperature rolling was conducted using a large-diameter work roll.

In the initial rolling passes (first and second passes), no magnetic flux density improving effect can be expected by use of a large-diameter work roll because the temperature of the steel sheet has not yet peaked.

When using deformation heating to increase the sheet temperature, the usual practice is to reduce the amount of supplied coolant oil. However, considering the need to ensure the minimum required lubricity and prevent roll seizure, it is difficult in the initial rolling passes (first and second passes) to reach a temperature range in which use of a large-diameter work roll can be expected to produce an effect of improving magnetic flux density.

The basic principle of the present invention is therefore to use a small-diameter work roll in the initial rolling passes to conduct high-reduction rolling under low rolling load and use a large-diameter work roll in the intermediate passes, thereby improving magnetic flux density by making suitable concurrent use of the effect of aging treatment by deformation heating. Moreover, a small-diameter work roll is used in the final cold rolling pass to reduce the cold-rolled steel sheet further to the required product sheet thickness.

Thus, the present invention establishes a rolling pass schedule that differentiates between use of small and large work rolls based on their respective actions and effects. The present invention is characterized by this point.

The fact that magnetic flux density improves when a large-diameter work roll is used in the intermediate passes was metallurgically ascertained by the inventors in the following manner.

Test pieces taken at ⅕ the thickness of 50 mm and 110 mm thick primary recrystallization annealed steel sheets were subjected to X-ray analysis and analysis by the SGH method (Harase et al.: Journal of the Japan Institute of Metals, vol. 29, no. 7, P552) to determine intensity of Goss orientation (IN) and intensity of Σ9 coincidence orientation (IcΣ9) around the ND axis. The results are shown in FIG. 5.

Figure 5:
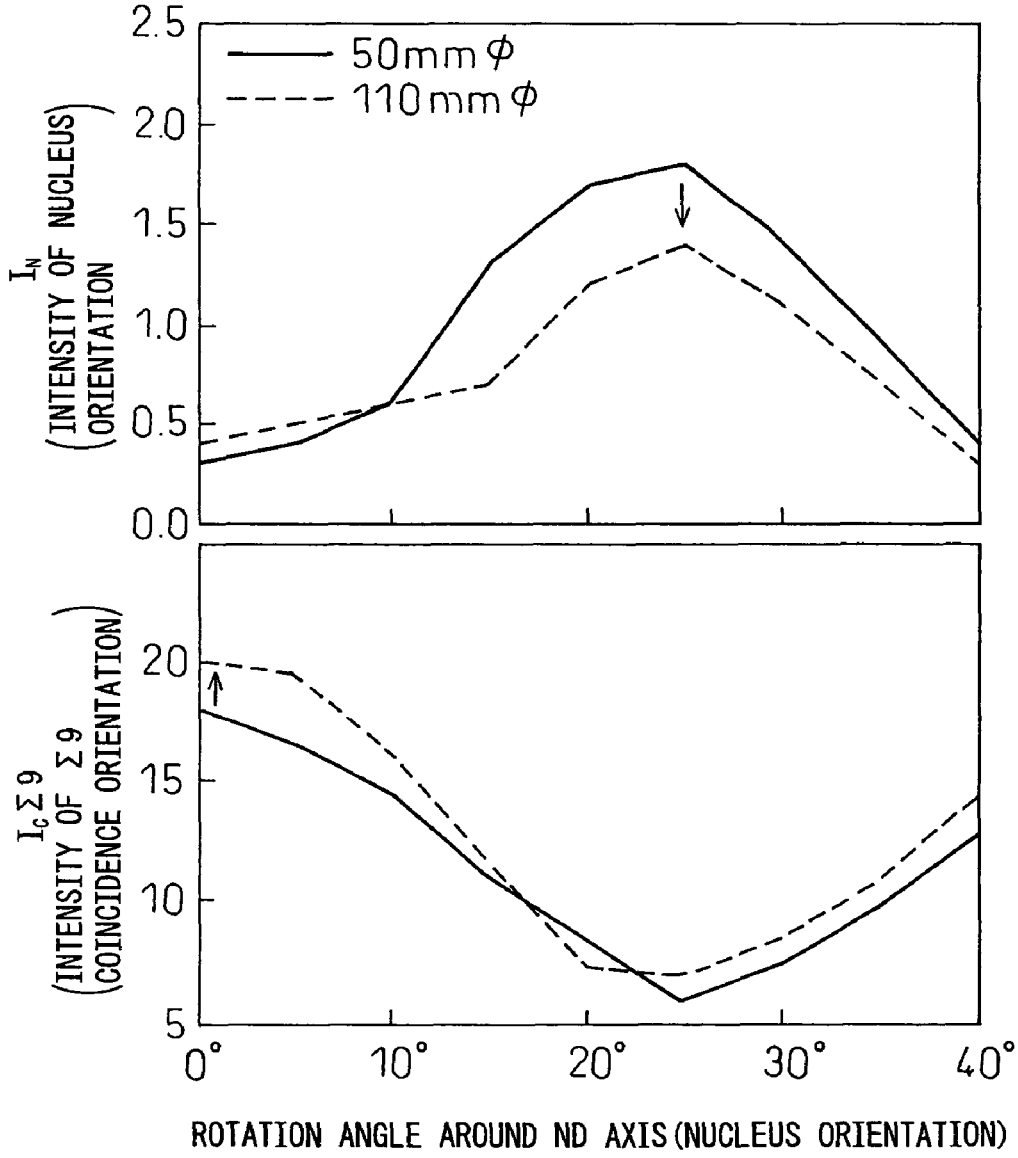
FIG. 5 is a diagram showing how intensity of Goss orientation (IN) and intensity of Σ9 coincidence orientation (IcΣ9) vary with rotation angle around the ND axis.

It can be seen from FIG. 5 that when the diameter of the work roll used in the intermediate passes is large (see broken-line curve in the drawing), IN intensity declines and IcΣ9 centered on the ND axis grows sharper in the vicinity of 25°.

In the production of grain-oriented electrical steel sheet with high magnetic flux density, the conditions required of the primary recrystallization structure are: (i) strong Goss orientation and (ii) sharp Σ9 coincidence orientation for preferential growth of Goss-oriented grains.

It is therefore clear from FIG. 5 that use of a large-diameter work roll in the intermediate passes results in adequate formation of a primary recrystallization texture ideal for enhancing the intensity of the Goss orientation of the secondary recrystallization texture.

Although the foregoing results are for the low-temperature slab heating method using AlN as inhibitor, the inventors also carried out a similar investigation with respect to the high-temperature slab heating method using MnS, Aln+MnS (MnSe) as inhibitors and further using Sn, Sb, Cu and the like as supplemental inhibitors.

The result was that the magnetic flux density improving effect of using a large-diameter work roll in the intermediate passes could be observed generally for composition systems using AlN as inhibitor. To the contrary, no such effect was observed for composition systems not containing AlN.

AlN has a stronger inhibitor effect than MnS (MnSe) and is thermally stable. This is presumed to be why the primary recrystallization texture effectively exhibits a magnetic flux density improving effect even when high-temperature rolling using a large-diameter work roll is conducted in the intermediate passes.

Although the mechanism governing the relationship between work roll diameter and primary recrystallization texture formation is unclear, the applicant has put forth the following hypothesis (see Japanese Patent Publication (A) No. 2001-192732 and No. 2002-129234).

When the diameter of the work roll used in the intermediate passes is small, the shear deformation component at the steel sheet surface region becomes large, so that the (110) plane strengthens and the (111) plane weakens after primary recrystallization (see Kono et al.: Iron and Steel, 68 (1982) p. 58). In the (110) plane at this time, the orientation group rotated around the ND axis from the Goss orientation increases to make the texture broadly undesirable.

Sharpening this texture effectively enhances magnetic flux density. Therefore, in the present invention, which uses a small-diameter work roll in the initial rollings (first pass, or first and second passes) to improve productivity, a large-diameter work roll is used in the intermediate passes to sharpen the primary recrystallized texture to one preferable for magnetic flux density enhancement.

The reasons for defining the chemical composition of the electrical steel slab used in the present invention (invention electrical steel slab) and the preferred composition will now be explained. Unless otherwise indicated, the symbol % used with respect to element content indicates mass %.

Al is an element indispensable as an inhibitor component. An Al content of 0.007% or greater is necessary to secure the required amount of inhibitor and realize high magnetic flux density. On the other hand, an excessive Al content degrades productivity by prolonging the slab heating time required in solution heat treatment. The upper content limit is therefore defined as 0.040%.

When the electrical steel slab is to be heated to a high temperature, AlN must be formed by conducting annealing prior to final cold rolling. In this case, therefore, the electrical steel slab is required bo contain N at a content of about 0.003 to 0.020%. On the other hand, when low-temperature slab heating is to be conducted, addition of N to the electrical steel slab is not necessary because AlN is formed by the nitriding following primary recrystallization. The N content of the electrical steel slab is therefore not particularly defined by the present invention.

C is an important element for forming austenite. A C content of 0.025% or greater is necessary. As excessive C content makes decarburization difficult, the upper limit is defined as 0.10%.

Si content must be 2.5% or greater to ensure the required electrical resistance and establish a good core loss property. However, an excessively high Si content increases the hardness of the steel sheet. As this makes cold rolling difficult, the upper content limit is defined as 4.5%.

Mn is an element entrained as an unavoidable component. However, it is added to a content of 0.03% or greater in order to exploit its toughness enhancing action. When Mn content is too high, heavy generation of MnS and/or MnSe makes solution treatment difficult even by high-temperature slab heating. The upper content limit is therefore defined as 0.55%.

S and Se combine with Mn to form MnS and MnSe, both of which act as inhibitors. S and Se are therefore suitably added with consideration to the type of inhibitors used. The preferable amount of addition is 0.01 to 0.04%, individually or in combination.

High-temperature slab heating is required for finely precipitating MnS and MnSe. In the case of low-temperature slab heating, fine MnS and MnSe are unnecessary because AlN is introduced as inhibitor by nitriding conducted downstream. In this case, the S and Se content is preferably 0.015% or less, so the present invention does not particularly specify the S and Se content of the electrical steel slab.

Aside from the aforesaid elements, one or more of Sn, Sb, Cu, Ni, Cr, P, V, B, Bi, Mo, Nb and Ge can be added for the purpose of improving the magnetic properties, in suitable amounts within ranges that do not impair the mechanical properties or surface properties of the steel sheet.

The production process conditions will be explained next. The invention electrical steel slab can be one produced by a conventional production method. After being sized to the required dimensions and shape, the electrical steel slab is heated to 1,100 to 1,450° C. in a heating furnace and subjected to hot rolling. The heating furnace can be an ordinary gas heating furnace, induction furnace or electrical resistance furnace.

The electrical steel slab heated to 1,100 to 1,450° C. is hot rolled to a hot-rolled steel sheet of the required thickness, annealed, and cold rolled multiple times using a split-housing reversible cluster rolling mill. During the cold rolling, aging treatment can be performed between the rollings. The aging can utilize either deformation heating or some other heating means. While the aging temperature and time can be suitably selected from within the conventional ranges, a temperature of 100 to 350° C. and period of 1 min or greater are preferable.

Optionally, the cold-rolled steel sheet can be annealed under conventional conditions prior to the final cold rolling. When high-temperature slab heating is to be conducted, this annealing is essential for finely precipitating an adequate amount of AlN (inhibitor) in the steel sheet.

On the other hand, when low-temperature slab heating is to be conducted, although annealing for AlN precipitation is unnecessary, annealing can be conducted prior to the final cold rolling in order to obtain a carbide precipitation state and/or solute C solid solution state that is more effective for the aging treatment suitably performed between passes.

Next, the steel sheet is cold rolled using the split-housing reversible cluster rolling mill. At this time, the cold rolling is preferably conducted at a total reduction of 81% or greater in order to finally form a secondary recrystallization texture with sharp Goss orientation and realize high magnetic flux density.

When aging treatment is performed between passes, it is important to hold the cold-rolled sheet at 100 to 350° C. for 1 min or greater.

As pointed out earlier, the present invention is characterized in that it establishes a rolling pass schedule that makes differential use of small and large work rolls based on their respective actions and effects. In other words, the present invention is based on technical concept of incorporating the different actions and effects of a small-diameter work roll and a large-diameter work roll into the electrical steel sheet production process.

Figure 1:
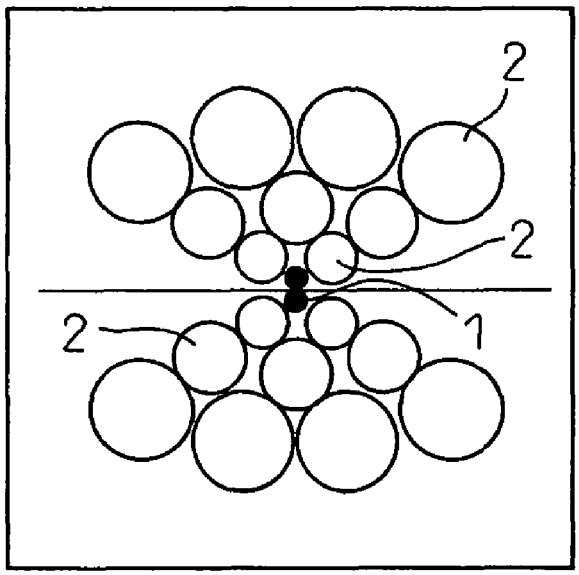
FIG. 1 is a set of diagrams showing Sendzimir rolling mill structures, in which (a) shows a mill built into a monoblock housing and (b) shows a mill built into a split housing.
Figure 1:
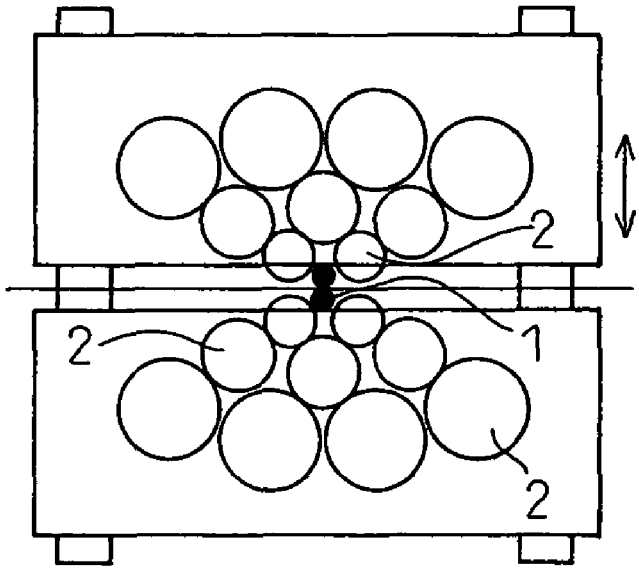

In addition, the present invention is characterized in using a split-housing reversible cluster rolling mill to implement this technical concept (see FIG. 1(*b*).

In the case of the monoblock housing shown in FIG. 1(*a*), although the diameter of the work roll can be changed by changing the intermediate roll, the diameter can be changed only within a small range of about 10 mm and the labor required for exchanging rolls is considerable.

In contrast, in the case of the split-housing shown in FIG. 1(*b*), a work roll of a substantially different diameter can be installed by elevating and lowering the upper and lower housing halves to adjust the bore size. In addition, the absence of roll chucks in the cluster rolling mill enables quick exchange of work rolls in the course of rolling without impairing productivity.

Split-housing reversible cluster rolling mills are equipped with 6-, 12- and 20-roll clusters (Sendzimir, NMS and other such mills) with an eye to enabling high-temperature rolling in the intermediate passes and stable thin sheet rolling in the final pass.

The diameters of the small-diameter work roll used to conduct high-reduction rolling at low rolling load in the initial rolling and the small-diameter work roll used to further reduce the cold-rolled steel sheet in the final pass must be smaller than the diameter of the large-diameter work roll used in the intermediate passes. With consideration to this, and also the findings shown in FIGS. 2 and 3, the diameter of the small-diameter work roll was defined as 55 mm to less than 105 mm.

When the diameter is less than 55 mm, the roll stiffness is insufficient and the roll may break even if backed up with backup rolls. The diameter of the small-diameter work roll is therefore specified as 55 mm or greater. But when the diameter is 105 mm or greater, the improvement in rolling reduction limit diminishes to the point of their being no advantage in using the small-diameter work roll. The upper limit of the diameter of the work roll used in the first and final cold rollings is therefore defined as less than 105 mm.

In order to achieve a pronounced improvement in rolling reduction limit without work roll breakage, the diameter of the work roll in the first and final cold rollings is preferably 70 to 95 mm.

In order to achieve excellent magnetic properties, the diameter of the work roll used in the intermediate passes starting from the second or third pass must be larger than that in the first and final cold rollings. The intermediate work roll diameter is therefore defined as 105 mm or greater.

Figure 6:
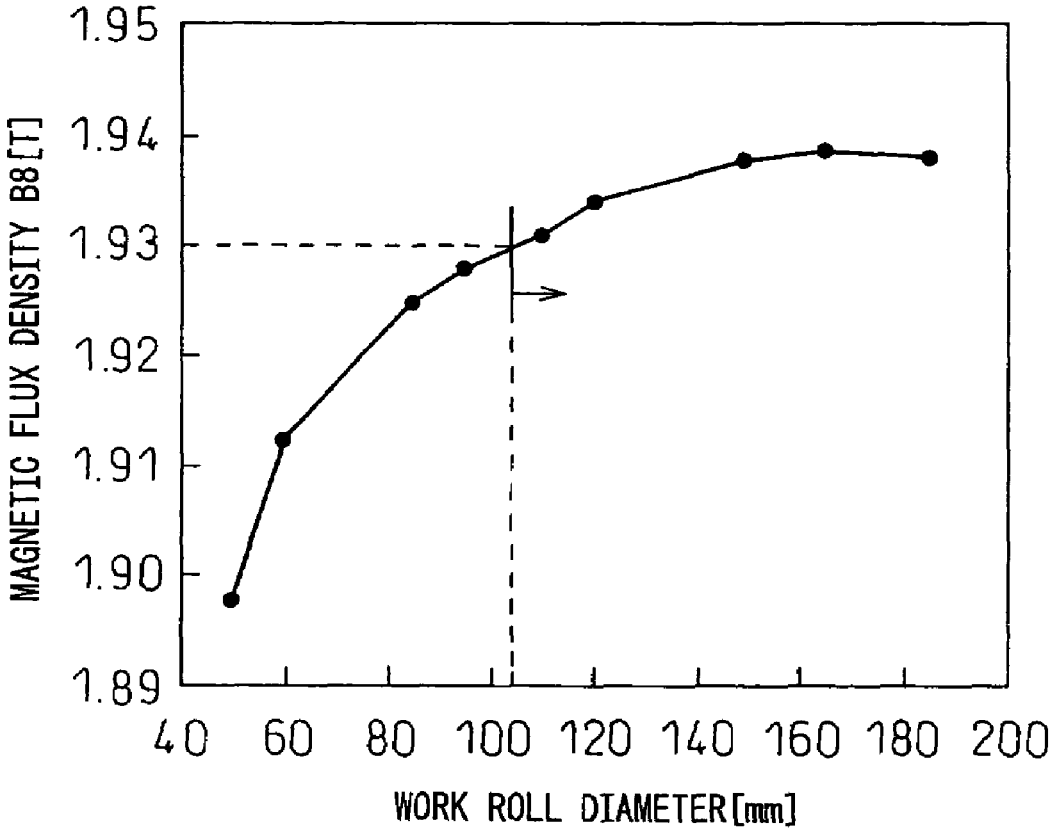
FIG. 6 is a diagram showing how magnetic flux density B8 varies with work roll diameter (mm).

FIG. 6 shows how magnetic flux density B8 [T] varies with the diameter of the work roll used in the intermediate passes. As shown in FIG. 6, use of a work roll of 105 mm or greater diameter in the intermediate passes starting from the second or third pass enables effective high-temperature rolling and realization of the magnetic flux density of 1.93 T or greater required by a high-flux-density grain-oriented electrical steel sheet. At a diameter of 150 mm or greater, however, the magnetic flux density tends to saturate.

A work roll of excessively large diameter cannot be expected to add further to magnetic flux density but, by making the size of the rolling mill large, is liable to increase maintenance, administrative and other facility costs, and also make roll exchange more burdensome. The upper limit diameter of the work roll used in the intermediate passes starting from the second or third pass is therefore defined as less than 150 mm.

Although the diameter of the work roll used in the intermediate passes starting from the second or third pass is defined as 105 mm to less than 150 mm, it is more preferably 115 mm to less than 150 mm from the viewpoints of reliably attaining magnetic flux density of greater than 1.93 T and ensuring optimum rolling machine handleability.

In the present invention, a small-diameter work roll is used in the final pass to additionally roll the cold-rolled steel sheet to the required product sheet thickness. It is possible to select a small-diameter work roll that enables the product sheet thickness to be reduced to 0.18 mm or less. It suffices for the diameter of the small-diameter work roll used in the final pass to be smaller than that of the work roll used in the intermediate passes starting from the second or third pass. However, taking rolling reaction force into consideration, it is preferably 55 mm to less than 105 mm, similarly to the work roll used in the initial rolling.

In the present invention, although a smaller number of cold rolling passes is preferable from the viewpoint of productivity, the number of passes need not be particularly defined because the suitable number differs with the type of steel. The preferred number of passes is 3 to 7.

Upon completion of the final rolling, the steel sheet is degreased and then subjected to decarburization and annealing involving primary recrystallization. When the heating temperature of the electrical steel slab is 1,250° C. or less (low-temperature slab heating), nitriding is conducted between primary recrystallization and secondary recrystallization in order to form AlN that functions as inhibitor.

The nitriding treatment is conducted in the course of the final annealing (see Japanese Patent Publication (A) No. S60-179885) or as the steel sheet is being annealed while passing through a mixed gas of "hydrogen+nitrogen+ammonia" (see Japanese Patent Publication (A) No. H1-82393). The amount of nitrogen required for reliably developing good secondary recrystallization grains is 120 ppm or greater, preferably 150 ppm or greater. Control of the primary recrystallization further improves the magnetic properties (see Japanese Patent Publication (A) No. H1-82939).

Next, the steel sheet is coated with an anneal-separating agent composed mainly of MgO slurry, coiled, and subjected to final annealing. Although the steel sheet is thereafter optionally applied with an insulation coating, the magnetic properties can be improved by subjecting it to magnetic domain refinement by a laser, plasma or mechanical method, etching, or other technique.

EXAMPLES

Working examples of the present invention will be explained next. It should be noted that the conditions used in the examples are for confirmational purposes only and the present invention is in no way limited thereto.

Electrical steel slabs a to f having the chemical compositions shown in Table 1 were heated at the slab heating temperatures shown in Table 2 and hot rolled into hot-rolled sheets of 2.0 to 2.8 mm thickness. In Table 2, a, b and c are cases of high-temperature slab heating and d, e and f are cases of low-temperature slab heating.

The hot-rolled sheets of Table 2 were cold rolled with a split-housing reversible cluster rolling mill under the rolling conditions shown in Table 3. Aging was conducted between passes at 200 to 350° C. for 1 min or greater using deformation heating.

Each cold-rolled sheet obtained was decarburizing annealed by an ordinary method, coated with magnesia by an ordinary method, finish annealed, given an insulation coating, straightened and baked to obtain a product steel sheet, and the magnetic flux density (B8) thereof was measured. The product steel sheet was subjected to magnetic domain control by a mechanical process, and the core loss (W17/50) was measured. The results are shown in Table 3.

In the Comparative Example in row a of Table 3, rolling was impossible because the diameter of the small-diameter work roll was 50 mm and smaller than the lower limit of 55 mm specified by the present invention.

In the Comparative Example in row b, although rolling was possible, the core loss property was inferior because the diameter of the small-diameter work roll was 54 mm, smaller than the lower limit of 55 mm specified by the present invention, and the diameter of the large-diameter work roll was 95 mm, smaller than the lower limit of 105 mm specified by the present invention.

In the Comparative Example of row c, the diameter of the small-diameter work roll was 110 mm, larger than the upper limit of less than 105 mm specified by the present invention, and the diameter of the large-diameter work roll was 150 mm, larger than the upper limit of less than 150 mm specified by the present invention. As both rolls were of large diameter, rolling mill handling was time consuming and productivity was therefore inferior.

In the Comparative Example of row e, the diameter of the small-diameter work roll was 109 mm, larger than the upper limit of less than 105 mm specified by the present invention. As the number of passes increased as a result, productivity was inferior.

TABLE 1

| | Chemical composition (mass %) | | | | | | | | | | |
|---|---|---|---|---|---|---|---|---|---|---|---|
| | C | Si | Mn | Al | S | N | Cu | Sn | Sb | Se | Other |
| a | 0.065 | 3.14 | 0.09 | 0.010 | 0.008 | 0.0091 | 0.01 | — | — | — | |
| b | 0.032 | 2.85 | 0.06 | 0.026 | 0.005 | 0.0101 | 0.01 | 0.11 | — | — | |
| c | 0.079 | 3.84 | 0.06 | 0.027 | 0.010 | 0.0059 | 0.02 | — | — | — | |
| d | 0.061 | 3.37 | 0.38 | 0.026 | 0.009 | 0.0027 | 0.01 | 0.06 | — | — | |
| e | 0.059 | 3.48 | 0.05 | 0.027 | 0.014 | 0.0053 | 0.19 | 0.09 | — | — | |
| f | 0.062 | 3.54 | 0.14 | 0.035 | 0.020 | 0.0082 | 0.20 | — | 0.021 | 0.012 | |

TABLE 2

| | Slab heating temperature (° C.) | Hot-rolled sheet thickness (mm) |
|---|---|---|
| a | 1350 | 2.0 |
| b | 1300 | 2.6 |
| c | 1290 | 2.0 |
| d | 1220 | 2.3 |

TABLE 2-continued

| | Slab heating temperature (° C.) | Hot-rolled sheet thickness (mm) |
|---|---|---|
| e | 1180 | 2.6 |
| f | 1140 | 2.8 |

TABLE 3

| | Hot-rolled sheet thickness (mm) | Final sheet thickness (mm) | Final reduction (%) | Small work roll diameter (mm) | Large work roll diameter (mm) | Number of passes | Flux density (T) | Core loss W17/50 (W/kg) | Remark | Example type |
|---|---|---|---|---|---|---|---|---|---|---|
| a | 2.0 | 0.285 | 85.8 | *50 | 105 | — | — | — | Rolling impossible | Comparative |
| | | | | 88 | 112 | 4 | 1.90 | 0.985 | | Invention |
| | | | | 78 | 107 | 5 | 1.89 | 0.981 | | Invention |
| b | 2.6 | 0.285 | 89.0 | *54 | *95 | 5 | 1.90 | 0.991 | Inferior core loss | Comparative |
| | | | | 101 | 108 | 6 | 1.92 | 0.978 | | Invention |
| | | | | 81 | 111 | 6 | 1.92 | 0.969 | | Invention |
| c | 2.0 | 0.220 | 89.0 | 75 | 110 | 5 | 1.90 | 0.799 | | Invention |
| | | | | 84 | 114 | 5 | 1.91 | 0.815 | | Invention |
| | | | | *110 | *150 | 6 | 1.91 | 0.821 | Increase in passes and handling time | Comparative |
| d | 2.3 | 0.220 | 90.4 | 101 | 105 | 6 | 1.91 | 0.803 | | Invention |
| | | | | 99 | 117 | 6 | 1.92 | 0.806 | | Invention |
| | | | | 87 | 109 | 6 | 1.92 | 0.795 | | Invention |
| e | 2.6 | 0.220 | 91.5 | 99 | 106 | 6 | 1.90 | 0.803 | | Invention |
| | | | | 76 | 112 | 6 | 1.91 | 0.784 | | Invention |
| | | | | *109 | 109 | 7 | 1.91 | 0.813 | Increase in passes | Comparative |
| f | 2.8 | 0.220 | 92.1 | 81 | 116 | 7 | 1.93 | 0.810 | | Invention |
| | | | | 78 | 112 | 7 | 1.92 | 0.799 | | Invention |
| | | | | 86 | 119 | 7 | 1.93 | 0.801 | | Invention |

*Outside invention range

INDUSTRIAL APPLICABILITY

As explained in the foregoing, in accordance with the present invention, it is possible, without impairing productivity, to produce a grain-oriented electrical steel sheet of 0.23 mm or less thickness that is excellent in magnetic properties. As this invention therefore contributes greatly to reducing the core loss, size and weight of transformers, generators and other electric equipment, it has applicability in the electrical equipment manufacturing industry.

What is claimed is:

1. A method of producing a grain-oriented electrical steel sheet comprising:

heating a slab containing, in mass %, C: 0.025 to 0.10%, Si: 2.5 to 4.5%, Mn: 0.03 to 0.55%, and Al: 0.007 to 0.040% to 1,100 to 1,450° C. or greater;

hot rolling the slab to obtain a hot-rolled sheet;

annealing the hot-rolled sheet;

cold rolling the annealed sheet multiple times with a split-housing reversible cluster rolling mill; and subjecting the cold-rolled sheet to primary recrystallization annealing followed by secondary recrystallization annealing, in which method of producing a grain-oriented electrical steel sheet:

(a) a first cold rolling or first and second cold rollings are performed using a work roll of 55 mm to less than 105 mm diameter;

(b) a second or third cold rolling to a penultimate cold rolling are performed using a work roll of 105 mm to less than 150 mm diameter; and (c) a final cold rolling is conducted using a work roll of a diameter smaller than the diameter of the work roll in the cold rolling of (b).

2. A method of producing a grain-oriented electrical steel sheet according to claim 1, wherein the diameter of the work roll in the first and final cold rollings is 70 to 95 mm.

3. A method of producing a grain-oriented electrical steel sheet according to claim 1, wherein the diameter of the work roll in the second or third cold rolling to the penultimate cold rolling is 115 mm to less than 150 mm.

4. A method of producing a grain-oriented electrical steel sheet according to claim 1, wherein the diameter of the work roll used in the final cold rolling is 55 mm to less than 105 mm.

5. A method of producing a grain-oriented electrical steel sheet according to claim 1, wherein inter-pass aging is performed at 100 to 350° C. for 1 min or greater during the second or third cold rolling to the penultimate cold rolling.

6. A method of producing a grain-oriented electrical steel sheet according to claim 5, wherein the aging is performed using deformation heating.

7. A method of producing a grain-oriented electrical steel sheet according to claim 1, wherein the number of cold rollings is 3 to 7.

* * * * *